US007816880B2

(12) United States Patent
Wenzel et al.

(10) Patent No.: US 7,816,880 B2
(45) Date of Patent: Oct. 19, 2010

(54) DEVICE FOR CONTROLLING THE MOVEMENT OF A MOVEABLE FURNITURE PART, AND A PIECE OF FURNITURE HAVING A DEVICE SUCH AS THIS

(75) Inventors: Holger Wenzel, Lindau (DE); Helmut Wetschko, Klaus-Weiler (AT); Carmelo Gutierrez, Ehringshausen (DE); Steffen Medebach, Wetzlar (DE); Frank Oberpichler, Giessen (DE); Jürgen Zipp, Braunfels (DE)

(73) Assignees: Grass GmbH, Hochst (AT); Kuester Automotive Door Systems GmbH, Ehringshausen (DE)

( * ) Notice: Subject to any disclaimer, the term of this patent is extended or adjusted under 35 U.S.C. 154(b) by 0 days.

(21) Appl. No.: 12/244,158

(22) Filed: Oct. 2, 2008

(65) Prior Publication Data

US 2009/0138134 A1 May 28, 2009

Related U.S. Application Data

(63) Continuation of application No. PCT/EP2007/003034, filed on Apr. 4, 2007.

(30) Foreign Application Priority Data

Apr. 4, 2006 (DE) ..... 20 2006 005 581 U

(51) Int. Cl.
*H02P 1/04* (2006.01)
*G05D 3/00* (2006.01)

(52) U.S. Cl. ..... 318/466; 318/468

(58) Field of Classification Search ..... 318/466, 318/468

See application file for complete search history.

(56) References Cited

U.S. PATENT DOCUMENTS

| | | | | |
|---|---|---|---|---|
| 6,109,774 | A | 8/2000 | Holmes et al. | |
| 6,685,288 | B1 | 2/2004 | MacMillan | |
| 2004/0100169 | A1 * | 5/2004 | Huber et al. | 312/319.5 |
| 2008/0115417 | A1 * | 5/2008 | Huber | 49/349 |

FOREIGN PATENT DOCUMENTS

| | | | |
|---|---|---|---|
| AT | 007 723 | U1 | 6/2005 |
| DE | 88 02 655 | | 8/1988 |
| DE | 0 497 040 | A1 | 8/1992 |
| DE | 101 05 756 | A1 | 8/2001 |
| DE | 203 08 256 | U1 | 6/2004 |
| DE | 20 2004 007 170 | U1 | 9/2004 |
| DE | 20 2005 013 128 | U1 | 12/2005 |
| DE | 10 2004 045 568 | A1 | 3/2006 |

(Continued)

*Primary Examiner*—Bentsu Ro
*Assistant Examiner*—Erick Glass
(74) *Attorney, Agent, or Firm*—Burr & Brown

(57) ABSTRACT

The invention relates to a device for controlling the movement of a moveable furniture part which can be moved, in a driven manner, relative to a stationary furniture part by means of a drive unit via a monitoring unit for monitoring the movement of the moveable furniture part. According to the invention, the monitoring unit can be operated in an operating mode and in a configuration mode, with the monitoring unit being designed to use additional means to enter a configuration mode in which the device can be configured. In addition, the invention relates to a piece of furniture having a device such as this.

13 Claims, 2 Drawing Sheets

FOREIGN PATENT DOCUMENTS

| | | | |
|---|---|---|---|
| DE | 20 2005 018 353 | U1 | 3/2006 |
| DE | 10 2004 045 567 | A1 | 4/2006 |
| DE | 20 2005 006 945 | U1 | 6/2006 |
| DE | 20 2006 002 103 | U1 | 8/2006 |
| DE | 20 2006 012 976 | U1 | 12/2006 |
| DE | 20 2006 012 656 | U1 | 2/2007 |
| DE | 20 2005 021 123 | U1 | 3/2007 |
| EP | 1 323 363 | A1 | 7/2003 |
| EP | 1 323 364 | A1 | 7/2003 |
| EP | 1 374 732 | A1 | 1/2004 |
| WO | 2004/100717 | A1 | 11/2004 |
| WO | 2004/100718 | A1 | 11/2004 |
| WO | 2005/058092 | A1 | 6/2005 |

* cited by examiner

DEVICE FOR CONTROLLING THE MOVEMENT OF A MOVEABLE FURNITURE PART, AND A PIECE OF FURNITURE HAVING A DEVICE SUCH AS THIS

CROSS REFERENCE TO RELATED APPLICATIONS

This application is a continuation of International Application No. PCT/EP2007/003034, filed Apr. 4, 2007, which designated the United States, and claims the benefit under 35 USC §119(a)-(d) of German Application No. 20 2006 005 581.9, filed Apr. 4, 2006, the entireties of which are incorporated herein by reference.

FIELD OF THE INVENTION

The invention relates to a device for controlling the movement of furniture parts, and to a piece of furniture including the device.

BACKGROUND OF THE INVENTION

Devices for controlling the movement of a plurality of furniture parts which can be moved with respect to a stationary furniture part are known from the prior art. The moveable furniture parts can be moved, in a driven manner, with the aid of a drive unit and a monitoring unit in order to monitor the movement of the moveable furniture parts.

By way of example, furniture parts which are guided such that they can move or can pivot on fittings, for example drawers, hatches, doors, folding doors or hatches, tablar panels, pharmacy cabinets and the like can be moved with respect to a furniture housing with mechanical or electrical assistance, for example driven by an electric motor. Particularly in modern applications, the requirements relating to the individual desires of the end user, for example in order to allow relatively high operating convenience, are becoming more stringent. In this case, one aim is to keep the complexity relating to this for production, installation and setting up of the device and of the piece of furniture comparatively low.

SUMMARY OF THE INVENTION

The object of the present invention is to provide a device for controlling the driven movement of moveable furniture parts, and a piece of furniture equipped with a device such as this, which make it possible to comply with the requirements relating to the individual desires of the end user, while minimizing the complexity required to do so.

The invention is based on a device for controlling the movement of a moveable furniture part which can be moved, in a driven manner, relative to a stationary furniture part by means of a drive unit via a monitoring unit for monitoring the movement of the moveable furniture part. One major aspect of the invention is that the monitoring unit can be operated in an operating mode and in a configuration mode, with the monitoring unit being designed to use additional means to enter a configuration mode in which the device can be configured. In addition to an operating mode, this therefore allows a configuration mode to be provided selectively and comparatively simply. In this case, it is possible to enter the configuration mode from the operating mode, and vice versa, directly.

In the past, the manufacture of the device and of the piece of furniture equipped with it has resulted in a particularly universal basic setting being available in actual use, which cannot practicably be changed by the end user or a layperson.

The additional means allow the configuration mode to be made possible, and to be used by the user at any time. In particular, basic settings for operation of the device for controlling movement and a piece of furniture equipped with it can be defined in the configuration mode. In the configuration mode, the additional means can be used to implement individual requirements and/or widely different settings, and/or to change them again or reverse them, as well. The additional means also ensure that inadvertent or accidental displacement of basic settings is virtually impossible. The additional means represent, so to speak, both a safety barrier and an access key for working in the configuration mode.

The additional means are advantageously different from a conventional PC or computer, or a conventional computation unit, which means that the additional means can be provided at considerably less cost and in a less complex form than them. However, it is also feasible for the additional means to comprise, for example, a small portable computer, a laptop, PDA, USB stick or the like.

The additional means are preferably provided in the monitoring unit. This allows the monitoring unit to be designed without any need for a further device and with little complexity such that the monitoring unit entirely or partially comprises the additional means.

For the purposes of the invention, the expression the monitoring unit means, for example, a regulation or control unit, in particular a computation or computer unit, which, in particular, comprises a component for monitoring the movement of a plurality of moveable furniture parts, and which may be responsible for all the relevant moveable furniture parts, and for monitoring each of them. Alternatively or additionally, the monitoring unit may have a plurality of subunits which communicate with one another and are responsible for monitoring the movement of the plurality of moveable furniture parts, with one subunit monitoring at least one of the moveable furniture parts.

By way of example, the additional means may comprise a program stored in the monitoring unit or may be in the form of a unit in the monitoring unit or the device which influences movement.

It is also possible that activation means for activation and/or deactivation of the configuration mode are provided, and are permanently installed on the device and/or the relevant furniture parts. To enter a configuration mode, and to activate it, in particular from the operating mode, in which the device generally is, appropriate initiation commands may be required. Initiation commands may, in particular, be issued from the outside by a person. By way of example, switchable control and activation means are provided for this purpose, via which someone can deliberately activate a configuration mode or deactivate it, in order to leave the configuration mode. Widely differing embodiments are feasible as activation means, for example as separate control elements, or control elements designed specifically for this purpose, or in the form of a further function of a control element which is required for other purposes.

The activation means for activation and/or deactivation of the configuration mode are preferably switchable. This allows the configuration mode to be defined and to be set in a clearly identifiable manner, as well as to be left again, by means of a switching process.

In one advantageous embodiment of the subject matter of the invention, the activation means are provided by the moveable furniture part, by means of whose manual movement by an operator the configuration mode can be activated and/or deactivated. This allows the configuration mode to be activated and deactivated in a particularly elegant manner and with virtually no additional complexity in comparison to conventional arrangements. This is also advantageous since, in any case, it is normal practice for a user to control the moveable furniture parts in order to operate them. The configuration mode can be activated in a particularly simple manner by a deliberate and/or predetermined control operation or influence on the moveable furniture part. If required, work can also be carried out in the activated configuration mode, and particularly in order to adjust target variables, by the control on the relevant moveable furniture part.

It is also possible that the monitoring unit is designed to enter the configuration mode with the additional means, which are in the form of a separate additional component. A person can therefore use a configuration mode particularly conveniently. For example, it is possible to work well with a compact and convenient additional component. Furthermore, accidental reconfiguration can in particular be virtually precluded. In particular, the additional component is used only for the configuration mode and can in this case exert control over the monitoring unit, for example to set an available passive program to active, or to carry out programming. Outside the configuration mode, to be precise in its deactivation state, the additional component in particular represents a passive element with regard to the device for controlling movement. The removable additional component can remain in the passive state in its fitted position, or can be removed from the device or the fitting location, for example on the piece of furniture.

The additional component can be fitted directly to the monitoring unit, particularly if the latter is easily accessible, or else can be brought into contact with the monitoring unit, even over a considerable distance, by means of appropriate connections, for example by means of cables or a distribution element. For example, it is feasible for a monitoring unit which is generally provided for a plurality of stationary furniture parts to be connected to them via at least one connecting line, with the additional component being indirectly connected to the connecting line or to a connecting line connected thereto. If required, one or more distribution element or elements can be integrated in the connecting lines, for example one distribution element in each case for each stationary furniture part.

If, for example, furniture sections are fitted to walls, side parts, front parts or bottom parts, suitable connections, in particular, can likewise be provided for the device for controlling movement and/or for the monitoring unit. The capability to remove the additional component allows the additional component to also be used for other monitoring units, to be precise with this advantageously being possible for maintenance, repair or modification of the internal structure, or programming of the additional component.

It is particularly advantageous for the separate additional component to be in the form of a plug-on part. This allows the additional component to be fitted to the device and removed from it again by one person, by one action and in a simple manner. The plugging-on process can also be used to generate the necessary contacts and connections. If necessary, for example if the additional component requires its own power source and there is no specific power supply line or power supply based on a battery or rechargeable battery for the additional component, a power supply can also be provided for the plug-on part and/or for the additional component, by being plugged on. In general, power is supplied via the power supply for the device for controlling movement.

In one preferred embodiment of the invention, the separate additional component has at least one control element. This allows a switching process to be carried out directly on the additional component. In particular, this allows the configuration mode to be switched on and off. Furthermore, if required, one of a plurality of different available configuration modes can be selected or activated in this way. This can be done using one and only one control element, or else a plurality of control elements. If a plurality of control elements are provided on the separate additional component, other control commands can be issued by them in the configuration mode, and/or can be transmitted to the monitoring unit.

However, a refinement of the additional component is also possible in which it has no switching or control elements. The configuration mode can then be activated, deactivated and/or selected using other means. For example, a control element may be provided on the piece of furniture or the furniture parts, for example in the form of a switch, a sensor or the like. As already explained, a moveable furniture part may also, in the wider sense, be considered to be a control element, for example by this being moved or being controlled, in particular by pushing and/or pulling.

Output means are advantageously provided in order to indicate information about the configuration mode to a person. Particularly in the configuration mode, it may be advantageous for a person who is working in the configuration mode for information about the configuration mode to be indicated and/or for feedback to be provided relating to configuration steps that have been taken. The information may be in such a form that the person is provided with an indication as to whether the configuration mode is active or inactive, which configuration of a plurality of possible configuration modes is currently active, and/or which state currently exists or has been reached in the current configuration mode. This can advantageously be done using output means of the additional means or of the separate additional component. The output means may be designed such that, in particular, audible, tactile and/or visual information can be passed to a person.

It is also possible that the monitoring unit be designed to operate in one configuration mode of a plurality of possible configuration modes. In modern systems or if it is intended to achieve different aims with the configuration process, it is frequently advantageous for different configuration modes to be available, from which it is possible to select for a desired configuration process. This is because, although a system can frequently be configured using just one configuration mode, situations, however, are also feasible in which the configuration process necessitates a plurality of selectable configuration modes and/or the entire configuration process comprises a plurality of individual configuration processes, each in different configuration modes.

In particular, the various configuration modes can be activated or selected via the additional means, for which purpose they may be equipped with at least one control element, or may have no such control element.

The monitoring unit is advantageously designed to operate in a configuration mode which is suitable for adjustment of a closing part which is formed between a front part of the moveable furniture part in the closed position with respect to the stationary furniture part. A front gap or closing gap, which is preferably adjustable or variable, is frequently formed between the moveable furniture part and the associated part when the moveable furniture part is in the closed state. By way of example, this may be advantageous or necessary in the case of so-called touch-latch arrangements. The monitoring unit is appropriately designed for this purpose, in particular in order to allow the closing gap to be adjusted or varied in the configuration mode and, in particular, this process can be assisted by the drive unit and/or electrically.

The monitoring unit is advantageously designed to operate in a configuration mode in order to allow the relevant moveable furniture parts to be associated with the associated stationary furniture part.

In addition, the monitoring unit may be designed to operate in a configuration mode in order to allow association between adjacent stationary furniture parts when a plurality of stationary furniture parts are present.

In particular, the additional component may be in the form of a so-called "dongle". The dongle may have a copying and/or programming protection function and may have the function of an electrical key. In particular, at least one switching and/or control element may be provided on the additional component or the dongle, by means of which, in particular, the configuration mode can be switched on and off.

For example, the dongle may have a multi-step, in particular for example a 3-step, switch or a control element. For example, a reset function can be stored in a first position or in "step 0" in order, for example, to delete a kitchen configuration for a kitchen application, and to return to the basic setting. In a second position or "step 1", the kitchen or the device for influencing movement is set to configuration readiness for the kitchen area. In a third position or "step 2", for example, a front gap of a moveable furniture part can be set electronically. If required, further steps may also be integrated in the switch or control element, in particular for additional functions or functions which will be included later, for example for child protection.

A basic setting may correspond to a works setting which, in particular, ensures emergency operation. For example, only one moveable furniture part or power supply may be open, and only this furniture part may be in motion.

The configuration process can be carried out by a person or by a fitter. The dongle or the additional component with the switch or control element is plugged onto a plug-in location in "step 1", thus switching the kitchen or the device for influencing movement for the kitchen area to the configuration mode. The person or the fitter taps all the moveable furniture parts of furniture parts arranged one above the other, from the bottom upwards. The furniture parts are therefore moved out, and remain in the open state. After tapping the first or lowest furniture part again, the stationary furniture part is closed off and the moveable furniture parts close automatically from the top downwards. The monitoring unit therefore knows which moveable furniture part is associated with the same stationary furniture part. A corresponding procedure is then carried out for all the other stationary furniture parts, for example for all the further housings in a kitchen.

If associated inner furniture parts are associated with one moveable outer furniture part, appropriate internal logic can be configured and it is thus possible to avoid collisions between fronts when lowering an inner furniture part.

When a moveable furniture part is opened, for example to the maximum opening distance or limit stop and a further moveable furniture part in the same housing is intended to be opened, this moveable furniture part stops shortly before the opening distance of the previously opened moveable furniture part, for example about 3 cm before it. In consequence, each moveable furniture part within one housing stops shortly before the opening distance of the previously opened moveable furniture part, for example about 3 cm before it. When it is intended to close a moveable furniture part, all the moveable furniture parts which have been opened to a lesser extent are automatically closed first of all, before the moveable furniture part that has been operated itself closes. This cascade-like movement profile within a stationary furniture part means that no logic is required for moveable inner furniture parts, and also eliminates the risk of collisions between moveable furniture parts located one above the other or one below the other.

The invention is also directed at a device for influencing the movement of a moveable furniture part which can be moved, in a driven manner, relative to a stationary furniture part by means of a drive unit via a monitoring unit for monitoring the movement of the moveable furniture part. One major aspect in this case is that the monitoring unit is designed to allow a movement to be controlled, on the basis of which the movement of the moveable furniture parts within an associated stationary furniture part is carried out immediately successively, in accordance with a predetermined procedure. A movement such as this, which may take place in the form of a cascade, of, for example, a plurality of open moveable furniture parts in a stationary furniture part may be advantageous in order to avoid collisions or injuries to a person.

The following procedure may be used for a cascade-like opening profile within a stationary furniture part: once all the stationary furniture parts have been configured in the manner mentioned above, a configuration process is carried out for adjacent furniture parts, for example furniture parts arranged at right angles to one another, by simultaneously tapping the two lowest moveable furniture parts of the two stationary furniture parts which are positioned at right angles to one another. The monitoring unit thus identifies adjacent stationary furniture parts which, for example, are at right angles to one another, and does not allow moveable furniture parts from these two stationary furniture parts to be moved or to be opened at the same time.

A corresponding procedure can also be adopted for stationary furniture parts which are located alongside one another in order, in particular, to minimize any risk of collision or jamming caused by furniture parts being moved at the same time in other stationary furniture parts which are in each case located alongside one another.

If one moveable furniture part is open or moves from a first of the two stationary furniture parts, then no moveable furniture parts of the second stationary furniture part can be opened at the same time. The configuration for stationary furniture parts which are arranged at right angles to one another or alongside one another is assumed only when the overall configuration has been completed per se, and/or when the configuration process has been completed by tapping for all the other moveable furniture parts which, for example, are not arranged at right angles to one another or alongside one another.

If the configuration process is incomplete, or if the operation of one moveable furniture part by tapping has been forgotten in the procedure, the moveable furniture part which has not been configured remains open after the additional component has been pulled off, and the associated moveable outer furniture part is also opened if the configuration of a moveable inner furniture part is not correct. In this situation, the incomplete configuration process is rejected again by the removal of the additional component.

The procedure for operation after the configuration process may be as follows:

Only one first moveable furniture part or a power supply can ever be moved in a driven manner. A further or second moveable furniture part may start approximately 10 to 70, in particular 40 millimeters, before closing of the closing furniture part. This makes it possible to keep the risk of being crushed low.

In particular, a plurality of moveable furniture parts may be open at the same time.

A cascade-like opening profile is predetermined within a stationary furniture part in order to avoid front collisions between drawers which are arranged one above the other or one below the other.

Moveable furniture parts of two stationary furniture parts which are arranged at right angles to one another or alongside one another cannot be moved at the same time. In particular, a moveable furniture part may be opened or moved only in one stationary furniture part.

The additional component may, for example, be fitted to a motor unit, for example an electric motor, to the power supply or to the monitoring unit of the device for influencing movement. The additional component or the dongle can also be fitted to a housing distributor on the piece of furniture.

By way of example, audible information can be transmitted via the additional component or the dongle indicating in a suitable manner to a person, for example, a currently valid configuration mode. This may be done, for example, by means of a beep tone, which is sounded, for example, every 5 seconds.

A "reset setting" can be adopted in particular in a dedicated configuration mode. This can be done, for example, via a switch or a control element on the additional component or the dongle.

In order to enter the configuration mode, a control action which is not carried out in practice can also be predetermined, and must be configured for this process. By way of example, one or more fronts of a moveable furniture part may be used as a control element. If, for example, one front or a moveable furniture part is opened ten times successively without any waiting time, the configuration mode can be activated in this way.

Furthermore, a closing gap or front gap can be set, for example electronically, using the additional means or the separate additional component.

The invention also relates to a piece of furniture having a stationary furniture part and at least one furniture part which can be moved in a driven manner, in particular having a drawer. One of the devices described above is advantageously provided for the piece of furniture. This makes it possible to achieve the advantages resulting therefrom for a corresponding piece of furniture.

In particular, the piece of furniture with the device for influencing movement is designed such that the additional means can be fitted to the piece of furniture in the form of a separate additional component. For example, the additional component for configuration can be plugged onto or connected to a corresponding fitting device on the piece of furniture, and can be removed again after the configuration process. In particular, the additional component can be fitted at an advantageous point, to be precise at a point which is easily accessible for a person, on the piece of furniture, in particular via a monitoring unit interface.

BRIEF DESCRIPTION OF THE DRAWINGS

The figures illustrate a highly schematically illustrated exemplary embodiment of the invention, with further advantages and details being indicated which will be described in more detail.

DETAILED DESCRIPTION OF THE INVENTION

Figure 1:
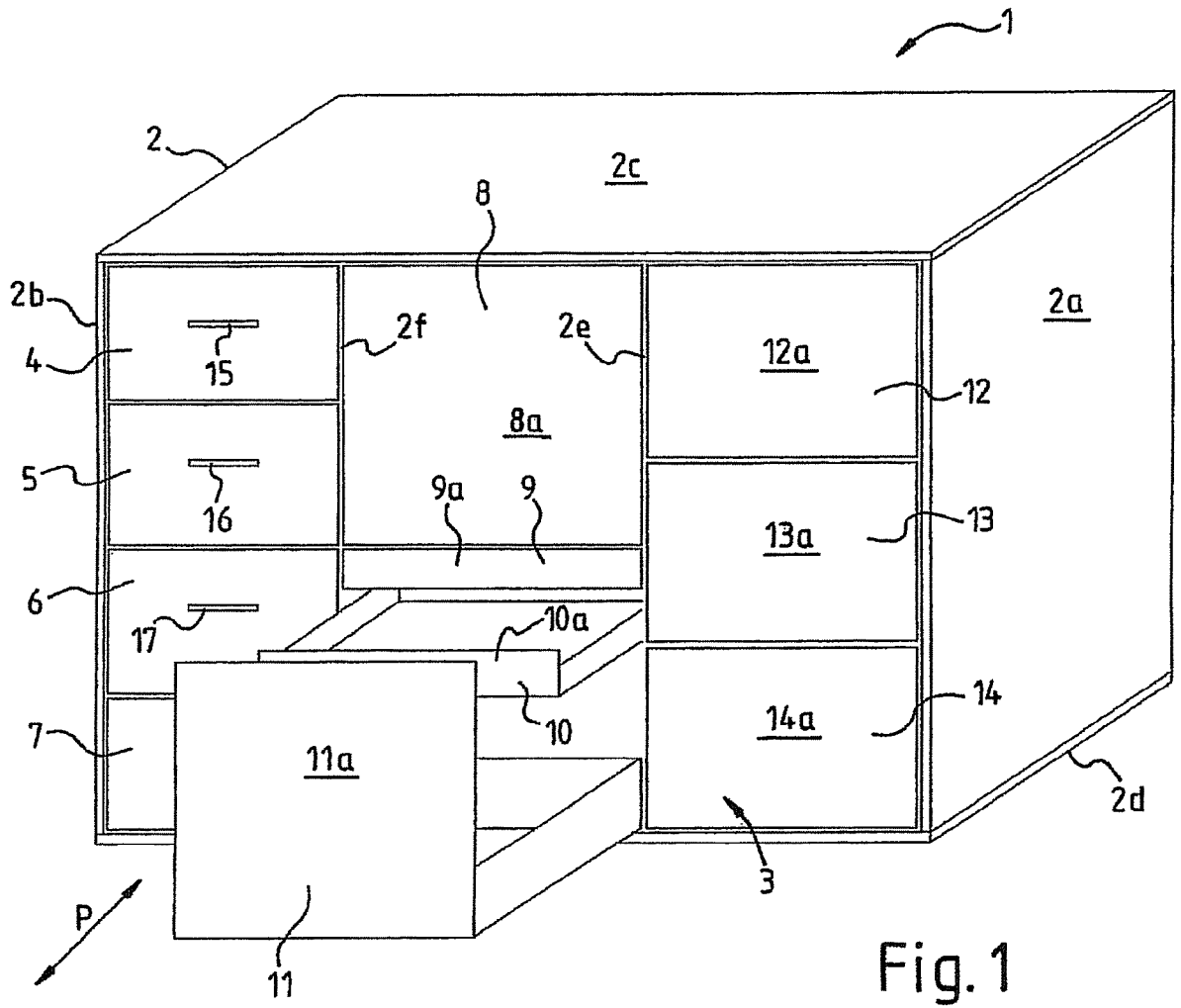
FIG. 1 is a front perspective view obliquely from above of a schematic piece of furniture.

FIG. 1 shows a piece of furniture 1 with a stationary furniture part or a furniture housing 2 and furniture drawer units 3, which are guided thereon such that they can move and have a plurality of drawers 4-14. The front part 11*a* of an outer drawer 11 may cover the front part 9*a* of an inner drawer 9 and the front part 10*a* of an inner drawer 10. When the furniture drawer units 3 are in the closed state, the piece of furniture 1 has a cuboid shape. The furniture housing 2 comprises two outer side walls 2*a* and 2*b*, an upper part 2*c*, a bottom part 2*d* and, in addition, a rear wall which cannot be seen in FIG. 1. The furniture housing 2 also has inner walls 2*e* and 2*f* which run parallel to the side walls 2*a*, 2*b* in the interior of the furniture housing.

The furniture drawer units 3 are held in the furniture housing 2 by means of pull-out guides, which are not illustrated, on the side walls 2*a*, 2*b* or the inner walls 2*e*, 2*f*, such that they can be moved, for example by means of known full drawer extensions. The furniture drawer units 3 may be pushed in and moved out relative to the furniture housing 2 as indicated by the double-headed arrow P. The drawers 4-9 and 12-14 are each located in the closed position while, in contrast, the inner drawer 10 is approximately half open and the outer drawer 11 is entirely open with respect to the furniture housing 2.

The front face of the piece of furniture 1 with front parts of the furniture drawer units 3 represents a control face for a person to operate the drawers 4-14. Looking at the front of the piece of furniture 1 as shown in FIG. 1, the arrangement of the drawers comprises three columns, each with a plurality of drawers positioned one above the other. The left-hand column, seen from the front, comprises the identical drawers 4-7 between the side wall 2*b* and the inner wall 2*f*, and the center column between the inner walls 2*e* and 2*f* comprises the drawers 8-11, while the right-hand column between the inner wall 2*e* and the side wall 2*a* comprises the drawers 12-14.

A device which is not illustrated in FIG. 1, for example corresponding to the device described in WO 2006/029 894 A1, for controlling the movement of the furniture drawer units 3 is provided for driven movement in particular of each furniture drawer unit 4-14 relative to the furniture housing 2, with the driven movement being achieved by means of a drive unit and a monitoring unit for monitoring the movement of the furniture drawer units 3. In addition, the drawing does not illustrate connecting lines or the like, for example in order to supply the device for controlling movement.

The drawers 4-6 are each provided on their drawer fronts with a handle element 15-17, and the drawer 7 is provided with a handle element which cannot be seen, in order to manually grip the relevant drawer and in particular to pull on the drawer. In principle, it is therefore possible for the drawers 4-7 not to be driven by the drive unit but just to be moveable by manual operation. It is also feasible for the drawers 4-7 to be moveable in a driven manner and manually in order, for example, when they are being moved manually by a person, to assist this movement by means of the drive unit, in particular during opening.

In particular, the other drawers can be moved by the drive unit, in which case it is feasible for a drawer which can be moved in a driven manner also to be moveable manually. The drive unit may be configured in many forms and with electrical means, for example with the aid of an electric motor, or may operate non-electrically with mechanical means, or may operate with a combination of these means. The opening and/or closing movement may be carried out entirely or partially driven, for example when ejection means are provided in order to eject the moveable furniture part from a closed position to an at least partially open position.

The drawers 8-14 have no contour and/or no handle element, or any other aid for pulling on the relevant furniture part, on their front parts 8*a*-14*a*. In particular, for example, the drawers 4-14 may be provided, or not provided, with an ejector or touch-latch functionality. For example, the drawers 8-14 can be initiated, to be precise opened or closed, by tapping on the front face of a drawer.

Various embodiments are feasible as an additional component. The additional component may be permanently integrated in the device for influencing movement, or else may be connected to it only at times. For example, the additional component can be fitted to the device, and removed again, by one simple action, for example by plugging on and pulling off. The additional component may comprise a separate part, for example a small computer or large computer, a laptop, a PDA, a network structure, a chip element or the like, or may be integrated in the device or the monitoring unit. Input and/or output means may be provided on the additional element, for example a keypad or at least one switch.

Figure 2:
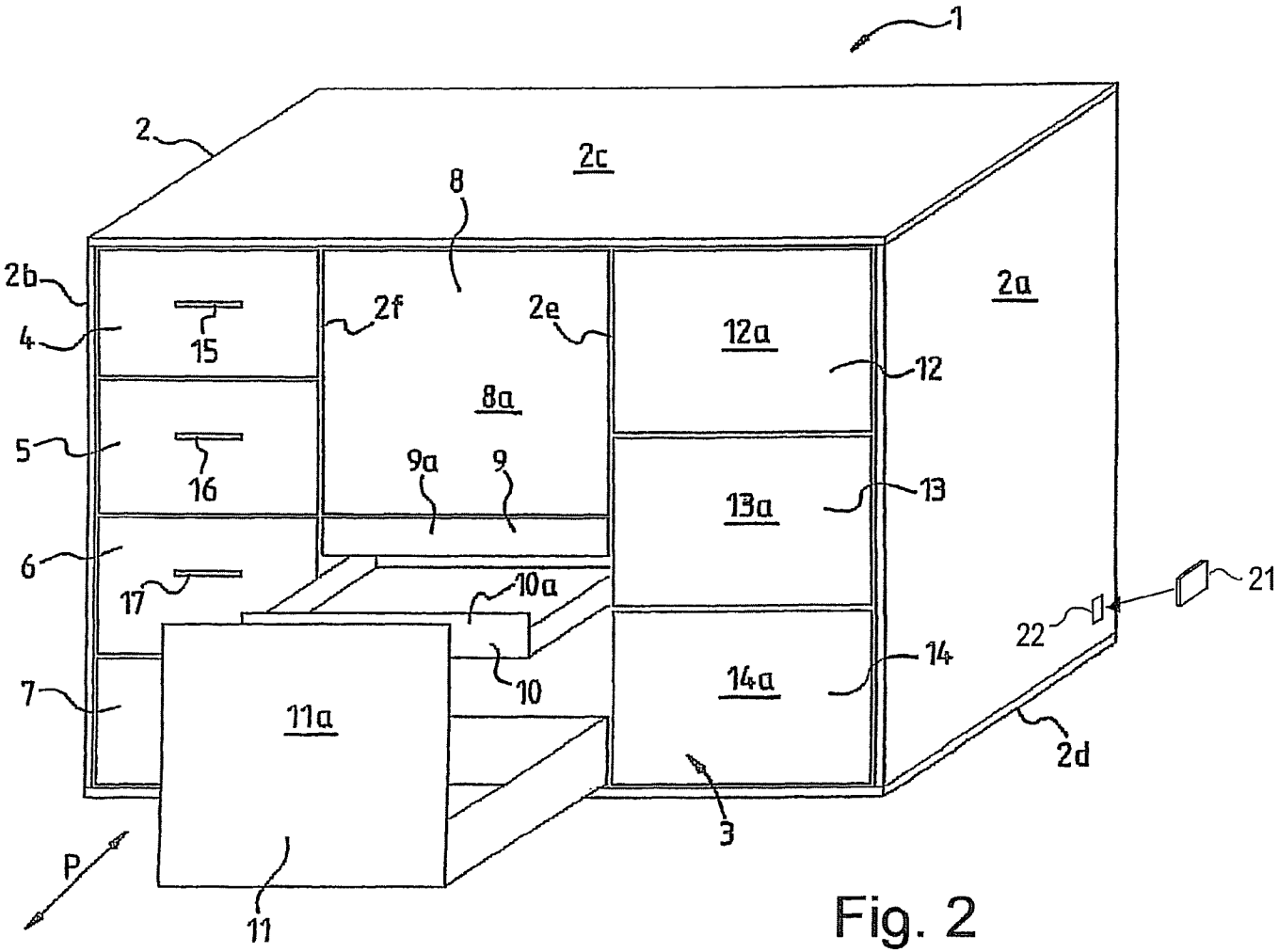
FIG. 2 is a front perspective view obliquely from above of another embodiment including a removable additional component and a plug-in location on the piece of furniture.

For example, the additional component 21 may also be in the form of an electronic switch or a so-called dongle, for example in the form of an electronic key, as shown in FIG. 2. The dongle can, for example, signal to a bus master that the configuration process is being carried out. One additional element or dongle may be delivered for each furniture unit or for a group of delivered furniture, for example for a kitchen with corresponding pieces of kitchen furniture, in order in particular to allow the general configuration process and in particular also the closing-gap configuration process. By way of example, the dongle may be plugged in on a free outlet of horizontal wiring. This allows even laypeople to carry out the configuration process without any problems.

In order to prepare for the configuration process, the dongle may in particular have a "configuration" switch position, which can be selected by a person. For this purpose, the dongle need just be plugged onto a plug-in location 22, for example of a drawer system as shown in FIG. 2. After waiting until a brief enabled tone sounds, the dongle is ready for use. The system identification process is then carried out and may last, for example, for about 1 minute. In the adjustment mode, the configuration process is started only after a continually repeating signal tone.

A reset function, or a process for resetting to basic settings, can be carried out by resetting the dongle to emergency operation. Alternatively, a switch on the dongle may be set to emergency operation. For this purpose, the dongle is plugged onto a free outlet on the piece of furniture or the device for influencing movement, and an appropriate signal is sounded for acknowledgement. It is now necessary to wait until a continually repeating signal sounds, and the dongle can then be removed. This procedure recreates a basic setting.

For optional front-gap setting using the dongle, a front view may be created in which all the relevant fronts of the moveable furniture parts or drawers are the same, and are aligned with one another. For example, a corresponding drawer is tapped with the dongle plugged on, and the system or the monitoring unit adds a pulse to the preselected basic setting or touch-latch position. The drawer moves to a new touch-latch position, which has a new front-gap size. By way of example, the configuration mode is ended when the desired closing gap is reached, by a preset time elapsing, or by operation of the switch on the additional component or some other control element.

The exemplary embodiment in FIG. 1 shows a piece of furniture with a plurality of drawers. However, the invention also relates to other pieces of furniture with furniture parts which can be moved in a driven manner, for example doors, hatches, tablar panels, wire baskets, pharmacy cabinets, rotating racks, carousels or the like.

LIST OF REFERENCE SYMBOLS

1 Piece of furniture
2 Furniture housing
2*a* Side wall
2*b* Side wall
2*c* Upper part
2*d* Bottom part
2*e* Inner wall
2*f* Inner wall
3 Furniture drawer units
4 Drawer
5 Drawer
6 Drawer
7 Drawer
8 Drawer
8*a* Front part
9 Inner drawer
9*a* Front part
10 Inner drawer
10*a* Front part
11 Outer drawer
11*a* Front part
12 Drawer
12*a* Front part
13 Drawer
13*a* Front part
14 Drawer
14*a* Front part
15 Handle element
16 Handle element
17 Handle element

We claim:

1. A device for controlling the movement of a moveable furniture part which can be moved in a driven manner relative to a stationary furniture part, comprising a drive unit for moving the moveable furniture part, and a monitoring unit for monitoring the movement of the moveable furniture part, wherein the monitoring unit is operated in an operating mode and in a configuration mode, and uses additional means to enter the configuration mode in which the device can be configured, wherein the additional means comprise a separate additional component which is in the form of a plug-on part that provides activation means for the activation and/or deactivation of the configuration mode, which activation means can be switched in order to activate and/or deactivate the configuration mode, and wherein the device operates as configured when the separate additional component is removed from the device.

2. The device as claimed in claim 1, wherein the additional means plugs into the monitoring unit.

3. The device as claimed in claim 1, wherein the activation means are permanently installed on the device and/or the moveable furniture part.

4. The device as claimed in claim 1, wherein the activation means are provided by the moveable furniture part, by means of whose manual movement by an operator the configuration mode can be activated and/or deactivated.

5. The device as claimed in claim 1, wherein the separate additional component has at least one control element.

6. The device as claimed in claim 1, further comprising output means to provide information about the configuration mode to a person.

7. The device as claimed in claim 1, wherein the monitoring unit operates in one configuration mode of a plurality of possible configuration modes.

8. The device as claimed in claim 1, wherein the monitoring unit operates in the configuration mode in order to enter a preset basic configuration.

9. The device as claimed in claim 1, wherein the monitoring unit operates in the configuration mode to adjust a closing gap which is formed between a front part of the moveable furniture part in the closed position with respect to the stationary furniture part.

10. The device as claimed in claim 1, wherein the monitoring unit operates in the configuration mode in order to allow the moveable furniture part to be associated with the stationary furniture part.

11. The device as claimed in claim 1, wherein the monitoring unit operates in the configuration mode in order to allow association between adjacent stationary furniture parts when a plurality of stationary furniture parts are present.

12. A piece of furniture comprising the device as claimed in claim 1.

13. A device for controlling the movement of a moveable furniture part which can be moved in a driven manner relative to a stationary furniture part, comprising a drive unit for moving the moveable furniture part, and a monitoring unit for monitoring the movement of the moveable furniture part, wherein the monitoring unit allows a movement to be controlled, on the basis of which the movement of the moveable furniture parts within an associated stationary furniture part is carried out immediately successively, in accordance with a predetermined procedure, and wherein the monitoring unit uses additional means to enter the configuration mode, the additional means is a separate additional component that is removable and the device operates as configured when the separate additional component is removed from the device.

* * * * *